US007218571B2

(12) United States Patent
Raleigh et al.

(10) Patent No.: US 7,218,571 B2
(45) Date of Patent: May 15, 2007

(54) MAGNETICALLY DRIVEN UNDERWATER PULSE GENERATOR

(75) Inventors: Michael Raleigh, Alexandria, VA (US); Yeshayahu Goldstein, Gaithersburg, MD (US); James Galambos, Alexandria, VA (US)

(73) Assignee: BAE Systems Advanced Technologies, Inc., Nashua, NH (US)

( * ) Notice: Subject to any disclaimer, the term of this patent is extended or adjusted under 35 U.S.C. 154(b) by 115 days.

(21) Appl. No.: 10/929,952

(22) Filed: Aug. 30, 2004

(65) Prior Publication Data

US 2006/0044937 A1 Mar. 2, 2006

(51) Int. Cl.
*H04K 3/00* (2006.01)

(52) U.S. Cl. ..... 367/1

(58) Field of Classification Search ..... 367/1, 367/148

See application file for complete search history.

(56) References Cited

U.S. PATENT DOCUMENTS 3,227,996 A * 1/1966 Hayward et al. ..... 367/141

* cited by examiner

*Primary Examiner*—Dan Pihulic
(74) *Attorney, Agent, or Firm*—Rossi, Kimms & McDowell LLP.

(57) ABSTRACT

An apparatus and method for magnetically generating an underwater high pressure pulse of sufficient strength to destroy underwater threats utilizes a pair of electrically conductive elements. The electrically conductive elements are arranged substantially parallel with each other and are separated by a gap. A pulse generator supplies an electrical pulse to at least one of the electrically conductive elements, which causes the generation of a magnetic repulsion force between the elements. The magnetic repulsion force causes one the electrically conductive elements to be displaced, thereby inducing a high pressure pulse in the liquid in which the pair of electrically conductive elements is submerged.

15 Claims, 9 Drawing Sheets

MAGNETICALLY DRIVEN UNDERWATER PULSE GENERATOR

STATEMENT OF GOVERNMENT INTEREST

The invention was made with United States Government support under Contract No. N00174-03-C-0046 awarded by DARPA. The United States Government has certain rights in this invention.

BACKGROUND

The present invention is directed to an apparatus and method for counteracting and defeating underwater threats posed to surface ships, submarines, marine facilities and underwater installations, specifically, those threats posed by objects such as torpedoes, underwater mines, explosives and hostile demolition personnel. In particular, the invention relates to an apparatus and method for generating high pressure shock waves that are capable of disabling or destroying underwater threats.

Marine assets are critical in maintaining both a viable military defense and a viable national economy. The ability to safely station and maneuver surface ships and submarines within a threat environment is critical to the success of a naval component of a national defense program. Similarly, marine facilities such as ports, underwater communication lines, drilling rigs and underwater pipelines are crucial to maintaining a viable national economy. Surface ships, submarines, ports and underwater installations, however, are susceptible to a variety of marine weapon systems including torpedoes, underwater mines, and explosives as well as hostile underwater demolition personnel. Thus, the protection of these assets is critical with respect to both military and economic defense programs.

A conventional method of countering a marine attack is to detect the presence of an incoming threat in sufficient time to launch a counter attack, and then to respond in kind with conventional weapons in an attempt to destroy the incoming threat. Although various conventional counter measure weapons may be employed, such counter measure weapons generally rely on conventional explosive ordinance that must be carried by the very ships that must be defended. The amount of ordinance that can be carried for the purpose of self-defense on a ship is limited, however, thereby necessitating a trade off between the offensive ability of a ship versus the ship's own self-defense capability. Further, conventional counter measure weapons require sophisticated firing control mechanisms to enable rapid target acquisition, and—given the limited amount of reaction time available after threat detection—such systems are necessarily susceptible to targeting errors that could prove detrimental or even fatal. Finally, the use of conventional explosives limits the possibility of a defense system that periodically fires to prevent infiltration, which would eliminate the need for sophisticated detection technology. For example, it is not practical to have large periodic conventional explosions occurring in a commercial port. Accordingly, conventional explosive ordinance defense systems are fired only when an actual threat has been detected, which in some cases may be too late for an effective response.

In view of the above, it would be desirable to provide an apparatus and method for counteracting and defeating underwater threats posed to surface ships and submarines without require the use of conventional explosives. It would further be desirable to provide an apparatus and method for defeating underwater threats that would allow for systematic and periodic firing to prevent infiltration of a marine threat.

SUMMARY OF THE INVENTION

The present invention provides an apparatus and method for counteracting and defeating underwater threats posed to surface ships, submarines, ports and underwater installations. Specifically, an apparatus and method for magnetically generating an underwater high pressure pulse of sufficient strength to destroy underwater threats utilizes a pair of electrically conductive elements. The electrically conductive elements are arranged substantially parallel with each other and are separated by a gap. A pulse generator supplies an electrical pulse to at least one of the electrically conductive elements, which causes the generation of a magnetic repulsion force between the elements. The magnetic repulsion force causes at least one the electrically conductive elements to be displaced; thereby inducing a high pressure pulse in the liquid in which the pair of electrically conductive elements are submerged. The conductive elements are returned to their initial positions after the electrical pulse dissipates.

The electrically conductive elements may comprise a variety of different elements. For example, in one preferred embodiment, at least one of the electrically conductive elements comprises a plate. In other preferred embodiments, at least one of the electrically conductive elements comprises a coil. Still other configurations and alternatives are possible, and will become apparent to those skilled in the art from the following detailed description of the preferred embodiments of the invention and the accompanying drawings.

BRIEF DESCRIPTION OF THE DRAWINGS

The invention will now be described in greater detail with reference to certain preferred embodiments thereof and the accompanying drawings, wherein.

DETAILED DESCRIPTION OF THE PREFERRED EMBODIMENTS

Figure 1:
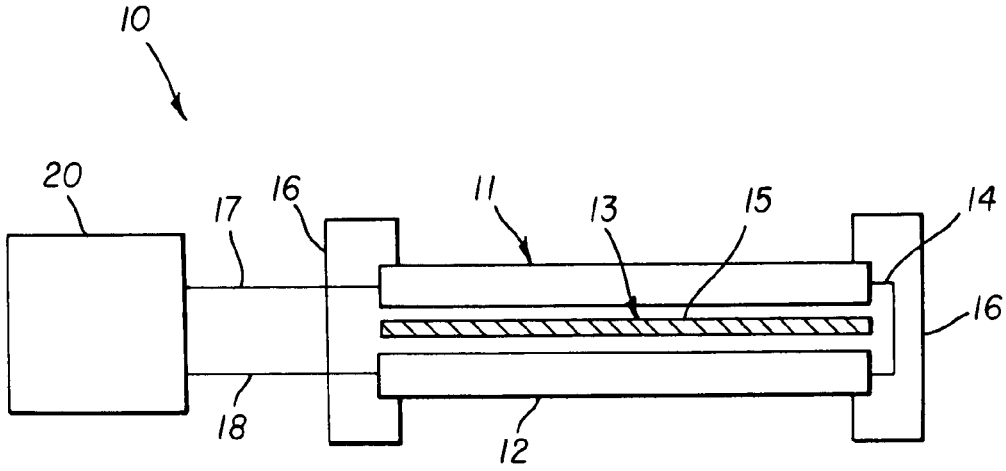
FIG. 1 is a schematic illustration of an apparatus in accordance with a first embodiment of the invention.

A magnetically driven underwater pressure pulse generator 10 in accordance with the present invention is schematically illustrated in FIG. 1. As shown in FIG. 1, a moveable electrically conductive plate 11 is positioned substantially parallel to a fixed electrically conductive plate 12 in a manner that provides a separation gap 13 between the movable electrically conductive plate 11 and the fixed electrically conductive plate 12. The movable electrically conductive plate 11 and the fixed electrically conductive plate 12 form an electrically conductive plate pair. An electrical connection 14 is placed in contact with the movable electrically conductive plate 11 and with the fixed electrically conductive plate 12, so as to allow current to flow between the movable electrically conductive plate 11 and the fixed electrically conductive plate 12. An electrical insulator 15 is placed within the separation gap 13. An electrically insulating mechanical edge connection 16 is placed at the edges of the movable electrically conductive plate 111 and the fixed conductive plate 12, so as to allow the movable electrically conductive plate 11 to be displaced vertically with respect to the fixed electrically conductive plate 12. The edge connection 16 essentially holds the combined structure together while allowing for the displacement of the conductive plate 11.

Figure 2:
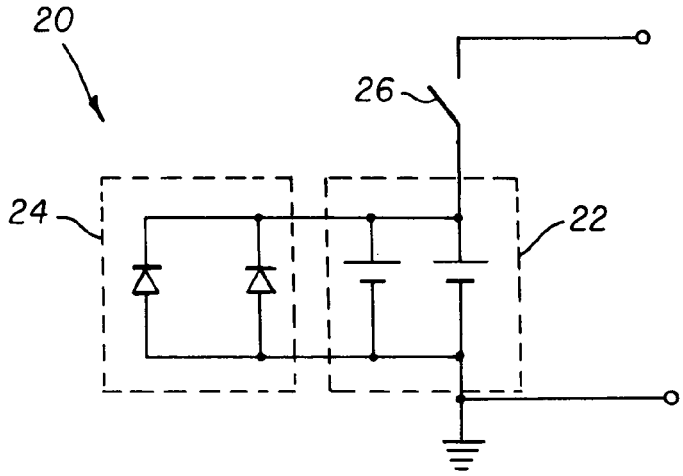
FIG. 2 is a circuit diagram of a pulse generator utilized in the apparatus illustrated in FIG. 1.

An electric pulse generator 20 is electrically connected to both the movable electrically conductive plate 11 and the fixed electrically conductive plate 12 by electrical connection 17 and electrical connection 18 respectively. An electrical circuit design of one preferred embodiment of the electric pulse generator 20 is depicted in FIG. 2. A capacitor bank 22 is preferably connected in parallel with a diode array 24. A switch 26 is connected in series with the capacitor bank 22, and is used to connect the capacitor bank 22 with the electrical connection 17 associated with the movably electrically conductive plate 11 shown in FIG. 1.

The magnetically driven underwater pressure pulse generator 10 functions by propagating a high pressure shock wave through the water in which it is submerged. The manner by which the shock wave is generated can be best understood with reference to FIG. 1 and FIG. 2. Referring first to the electric pulse generator 20 of FIG. 2, pulse initiation occurs by closing the switch 26 to complete the electrical circuit, which results in the discharge of the capacitor bank 22. In the illustrated preferred embodiment, the switch 26 is an ignitron tube (but other devices such as solid state or vacuum switches may be employed), and the capacitor bank 22 may consist of a single capacitor or multiple capacitors connected in parallel. The discharge produces a current pulse through the electrical connection 17 to the movable electrically conductive plate 11. The diode array 24, which may be composed of a single diode or of multiple diodes connected in parallel, is used to shape the electrical current pulse generated by the discharge of the capacitor bank 22. Accordingly, the high pressure pulse produced by the magnetically driven underwater pressure pulse generator 10 is shaped based on the shaping of the electrical current pulse.

Referring to FIG. 1, the current pulse is transmitted via connection 17 to the movable electrically conductive plate 11. The current pulse flows through the movable electrically conductive plate 11 and is transmitted to the fixed electrically conductive plate 12 via the electrical connection 14. The current flow in the fixed electrically conductive plate 12 is oriented in a direction opposite to the current flow in the moveable electrically conductive plate 11, which results in a magnetic repulsion force being generated between the electrically conductive plate 11 and the fixed electrically conductive plate 12. The magnetic repulsion force causes the electrically conductive plate 11 to be displaced away from the electrically conductively plate 12 and against the water in which the device is placed. Accordingly, in this embodiment, the electrically conductive plate 11 is the "active" side of the device that induces a pressure pulse in the water. Namely, the displacement of the electrically conductive plate 11 due to the magnetic repulsion force in turn induces a high pressure shock wave in the water.

As noted above, the electrically insulating edge connections 16 are designed to allow for the displacement of the movable electrically conductive plate 11. In the preferred illustrated embodiment, the electrically insulating edge connections 16 are arranged to create a vacuum between the movable electrically conductive plate 11 and the fixed electrically conductive plate 12 when the movable electrically conductive plate 11 is displaced. The vacuum causes the movable electrically conductive plate 11 to return to its original position after displacement, thereby restoring the separation gap 13 to its initial distance.

In the embodiment described above, the capacitor bank 22 and the diode array 24, in conjunction with the inductance of the movable electrically conductive plate 11 and the fixed electrically conductive plate 12, combine to form a pressure pulse with an abrupt beginning and a long exponential tail. The pressure pulse is similar to a pressure pulse generated by an underwater explosion caused by conventional explosives, and is sufficient to severely damage or destroy underwater threats of the type discussed above. Namely, the shock wave causes the detonation or crushing of underwater mines and torpedoes while incapacitating personnel under the water. Pulse shapes of other forms may be obtained by varying the arrangement of the capacitor bank 22.

It is preferable that the stray capacitance be kept to a minimum, as the stray inductance of the circuit impacts the shape of the pressure pulse generated. Likewise the efficiency of the device is impacted by the stray resistance of the circuit and the resistance of the movable electrically conductive plate 12 and fixed electrically conductive plate 11. In a preferred embodiment, in order to minimize the resistance, the movable electrically conductive plate 111 and the fixed electrically conductive plate 12 are made of copper, with a thickness that is several electrical skin depths thick. In alternative embodiments, the movable electrically conductive plate 12 and fixed electrically conductive plate 11 may be made from other conductors such as aluminum.

Figure 3:
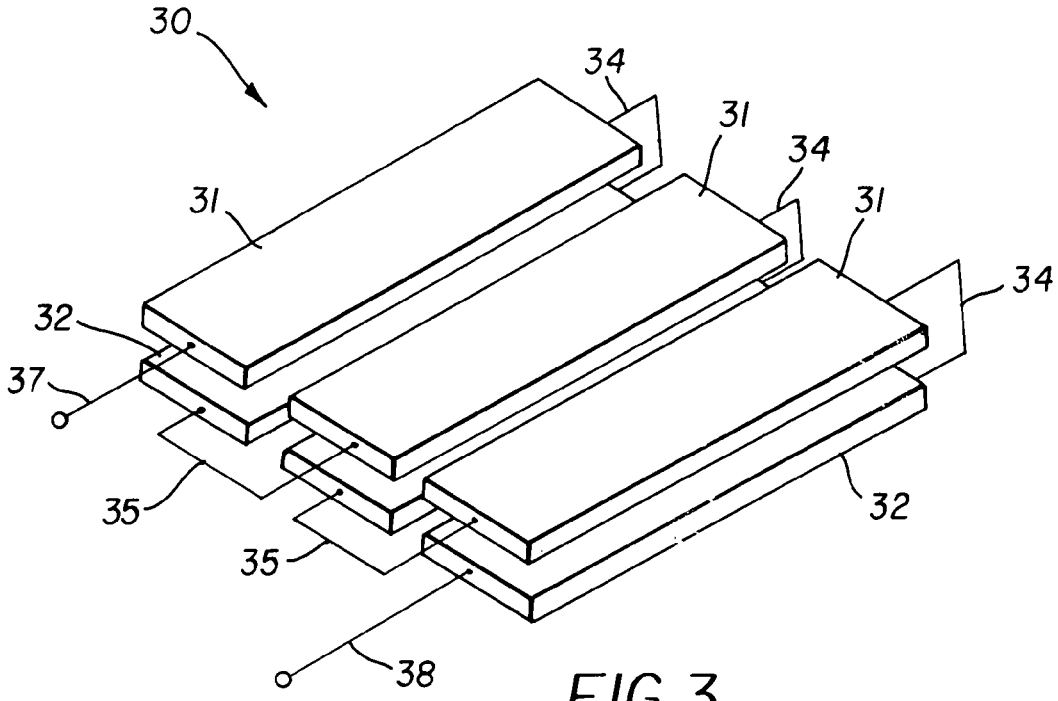
FIG. 3 is a schematic illustration of an embodiment of the invention that utilizes an array of conductive plate pairs.

FIG. 3 illustrates a further embodiment of the invention in which the single pair of the movable electrically conductive plate 11 and fixed electrically conductive plates 12 of the embodiment of FIG. 1 is replaced with an array of electrically conductive plate pairs. Each of the electrically conductive plate pairs includes a movable electrically conductive plate 31 and a fixed electrically conductive plate 32. The movable electrically conductive plate 31 is electrically connected with its paired fixed electrically conductive plate 32 via connection 34. The fixed electrically conductive plate 32 of one pair is connected with the movable electrically conductive plate 31 of a separate pair by connection 35, so as to allow current to flow through all pairs contained in the array. The array pairs are connected with an electric pulse generator (not shown) via electrical connection 37 and electrical connection 38 (corresponding to electrical connection 17 and electrical connector 18 of FIG. 1). The electrically insulating end connections and electrical insulator within the separation gap shown in FIG. 1 are not repeated in subsequent embodiments in order to simplify the drawings, but will be understood as being present by those skilled in the art. The array of electrically conductive plate pairs illustrated in FIG. 3 can be designed to generate a pressure pulse of desired shape, amplitude and propagation distance.

Figure 4:
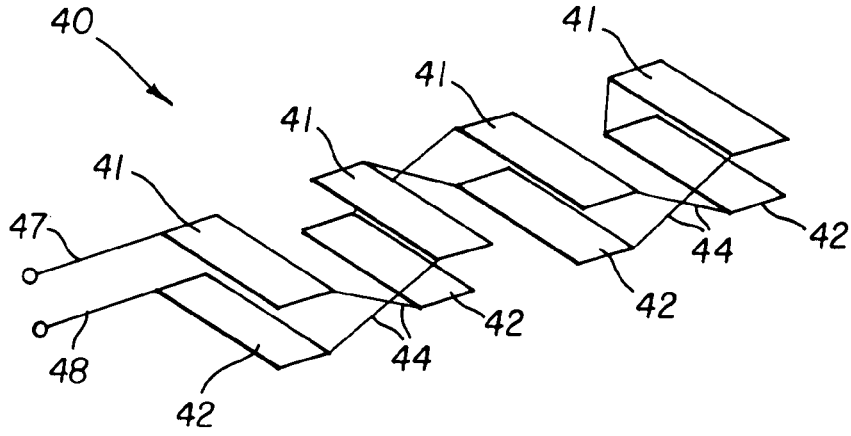
FIG. 4 is a schematic illustration of an embodiment of the invention that utilizes plates configured in a solenoid arrangement.

A further embodiment of the present invention is illustrated in FIG. 4. In this embodiment, pairs of movable electrically conductive plates 41 and fixed electrically conductive plates 42 are arrayed to form a flattened solenoid winding arrangement. Each movable electrically conductive plate 41 is positioned parallel to a fixed electrically conductive plate 42 with a gap there between, and is interconnected by electrical connections 42. The flattened solenoid arrangement of electrically conductive plates 41 and 42 is electrically connected to an electric pulse generator (not shown) via electrical connections 47 and 48. FIG. 4 depicts a 4-turn solenoid arrangement. Each movable electrically conductive plate 41 is positioned parallel to a corresponding fixed electrically conductive plate 42, and is displaced away from the fixed electrically conductive plate 42 due to a magnetic repulsion force generated when an electrical pulse is applied to the electrical connections 47, 48.

Figure 5:
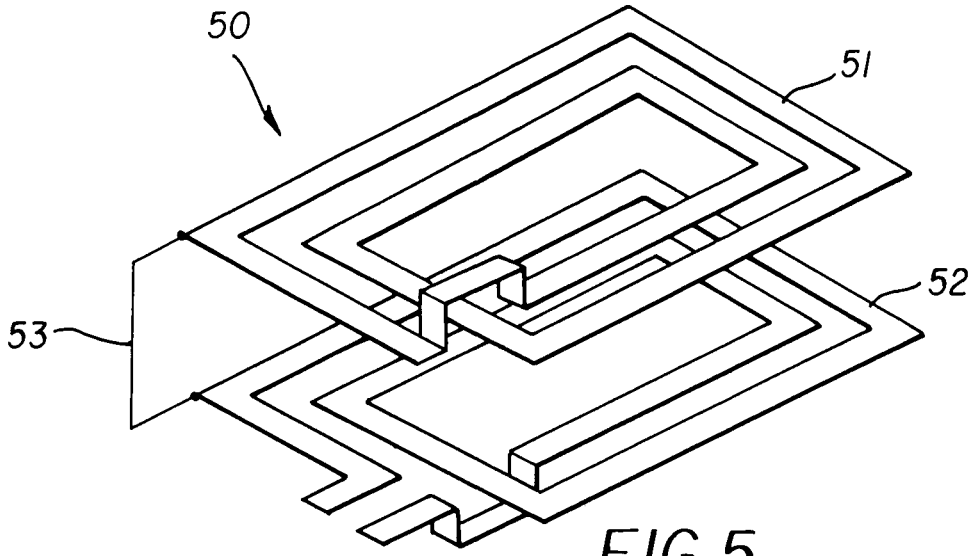
FIG. 5 is a schematic illustration of a further embodiment of the invention that utilizes inductively coupled coils.

FIG. 5 illustrates yet a further embodiment of the present invention. In this embodiment, the movable electrically conductive plate 11 and the fixed electrically conductive plate 12 of FIG. 1 are replaced with inductively coupled electrically conductive movable pancake coils 51 and 52, respectively. Elements 51 and 52 are individual strips of conductor arranged in spiral or coiled pattern. The movable electrically conductive pancake coil 51 is positioned parallel to the fixed electrically conductive pancake coil 52 and separated there from by a gap 53. Only the fixed electrically conductive pancake coil 52 is connected to the electric pulse generator (not shown). Current in the fixed electrically conductive pancake coil 52 causes an inductive current to flow in the movable conductive pancake coil 51, thereby resulting in magnetic repulsion that causes the movable electrically conductive pancake coil 51 to be displaced, thus generating a pressure pulse through the surrounding water.

Figure 6:
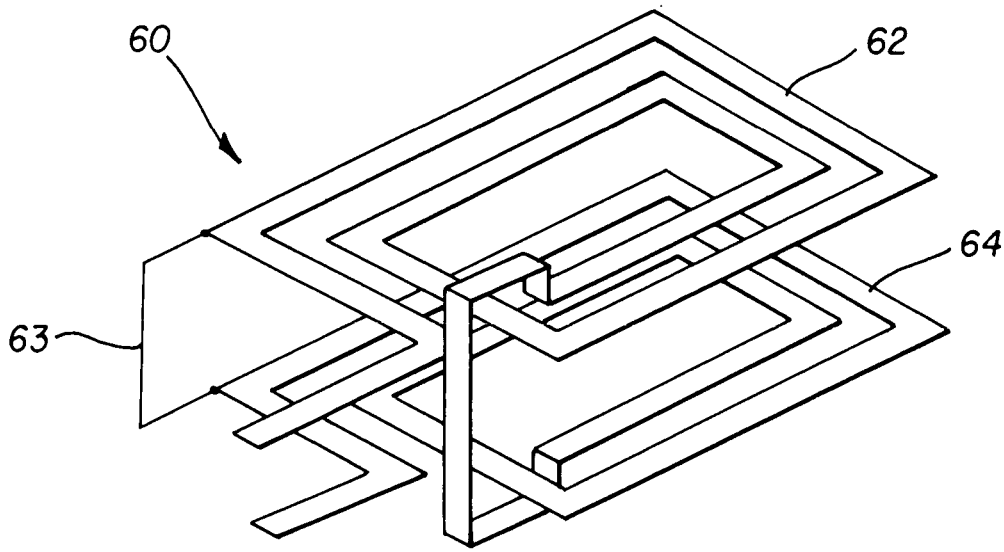
FIG. 6 is a schematic illustration of a still further embodiment of the invention that utilizes a DC coil.

A still further embodiment of the invention is depicted in FIG. 6. Here, the configuration is similar to FIG. 5, but instead of an inductively coupled pair of electrically conductive pancake coils 51, 52, a direct current (DC) wired electrically conductive pancake coil 60 is configured to operate as a pair of parallel electrically conductive plates as shown in FIG. 1. The DC wired electrically conductive pancake coil 60 consists of a movable coiled portion 62 and a fixed coiled portion 64 separated by a gap 63. The two ends of the DC wired electrically conductive pancake coil 60 are connected to an electric pulse generator (not shown). A current pulse through the DC wired electrically conductive pancake coil 60 generates the magnetic repulsion force necessary to cause the displacement of the movable coiled portion 62, which in turn generates a pressure wave through the water.

Figure 7:
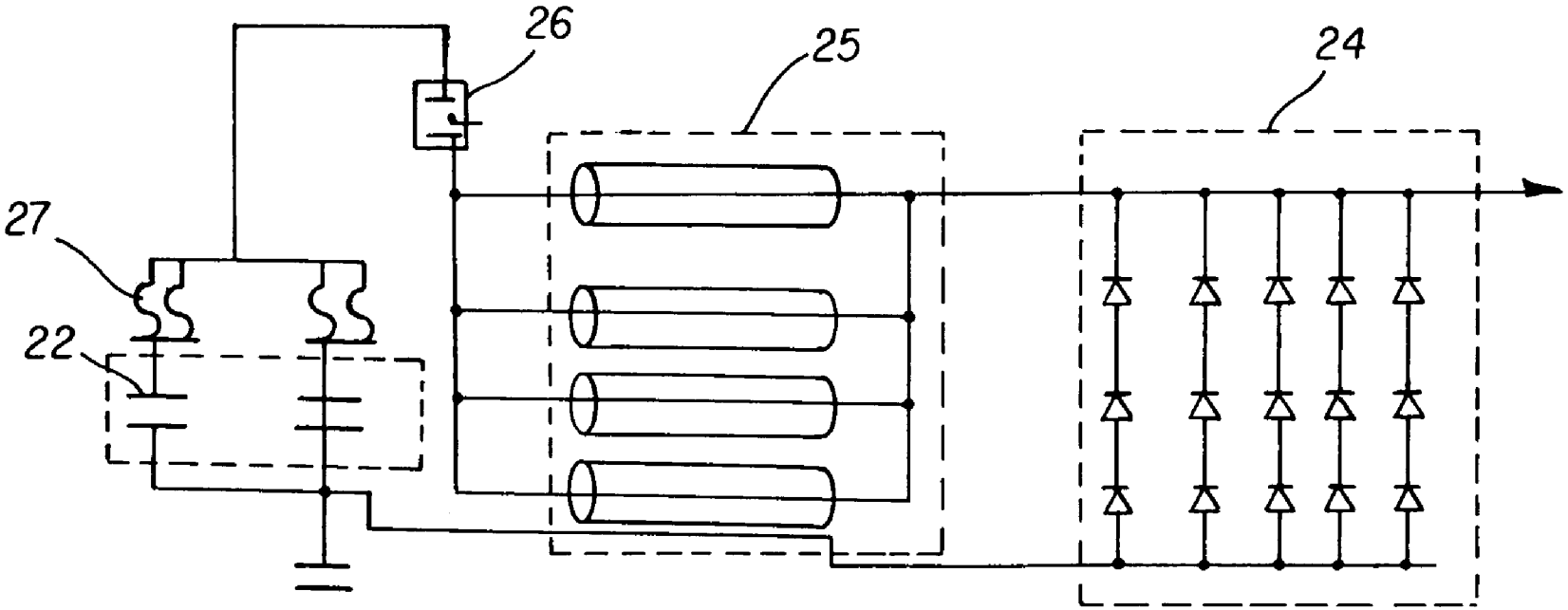
FIG. 7 is an electrical schematic diagram of a further embodiment of a pulse generator to be employed in the present invention.

In addition to various embodiments of the types of conductive elements that may be employed, FIG. 7 illustrates an alternative circuit design for an electric pulse generator. In this embodiment, fuses 27 are include to protect the capacitor bank 22 from internal short circuits. An ignitron 26 (or functionally equivalent device) is used to switch the electric pulse generator ON. To affect a lower stray inductance and resistance in the circuit, twelve parallel coaxial cables 25 are used to transmit the pulse to the load. A diode array 26 is arranged on the load side rather than on the sourced side to further reduce the circuit losses.

Figure 8:
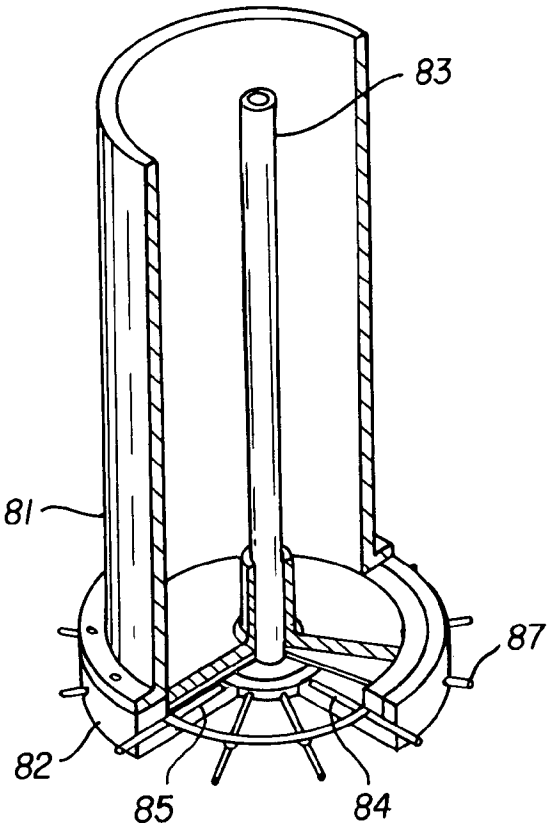
FIG. 8 is a cut away perspective view of a device in accordance with the invention in which a moveable plate is shown in an initial position.

FIG. 8 illustrates a working embodiment of the invention. As shown in FIG. 8, the device includes an outer tube or shroud 81 connected to a bottom support base 82. An extending guide rode 83 is secured in the bottom support base 83. A fixed electrical coil 84 is located within the bottom support base 82 and is covered by an insulator 85. A moveable aluminum upper plate 86 is provided that slides over the extending guide rod 83 and fits within the shroud 81. The aluminum upper plate 38 includes a coil that is inductively coupled to the fixed electrical coil 84 located within the bottom support base 82. For example, a thin copper plate provided on the lower surface of the aluminum upper plate 38 is preferably utilized to effectively function as a one turn coil.

Figure 9:
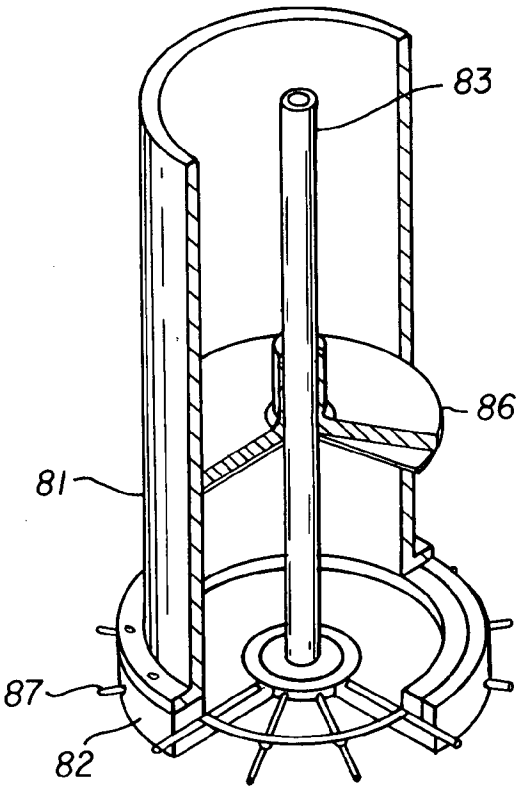
FIG. 9 is a cut away perspective view of a device in accordance with the invention in which a moveable plate is shown displaced from a corresponding fixed coil.

In operation, a voltage pulse is applied to the fixed electrical coil 84 via conductors 87 from a pulse generator (not shown). The application of the electrical pulse to the electrical coil 84 results in a magnetic repulsion force being generated between the electrical coil 84 and the moveable plate 86. As a result, the moveable plate 86 is displaced with respect to the fixed electrical coil 84 (as illustrated in FIG. 9), thereby inducing a shock wave into the water in which the device is submerged. It should be noted that the movement of the moveable plate 86 is greatly exaggerated in FIG. 9 for purposes of illustration. In fact, the actual displacement of the plate is quite small while still inducing a large shock wave in the water.

Figure 10:
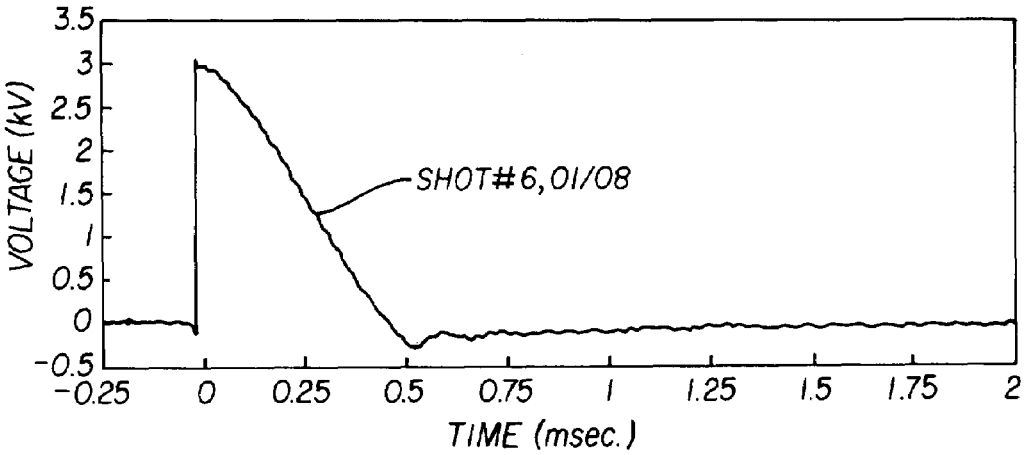
FIG. 10 is a graph illustrating voltage vs. time of a pulse applied to the device of FIG. 8.
Figure 11:
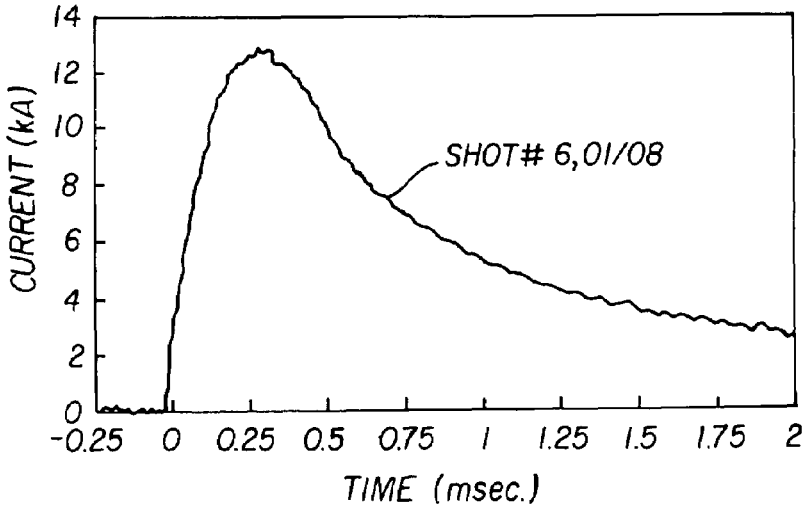
FIG. 11 is a graph illustrating current vs. time of a pulse applied to the device of FIG. 8.
Figure 12:
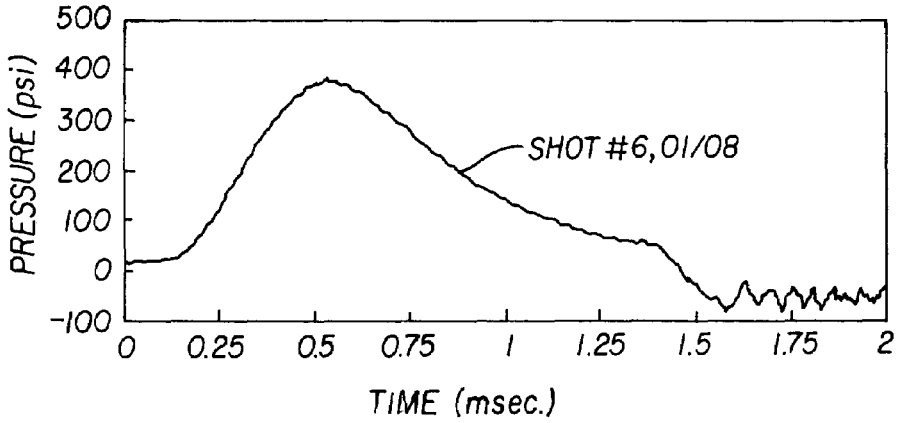
FIG. 12 is a graph illustrating pressure vs. time of a pulse generated by the device of FIG. 8.
Figure 13:
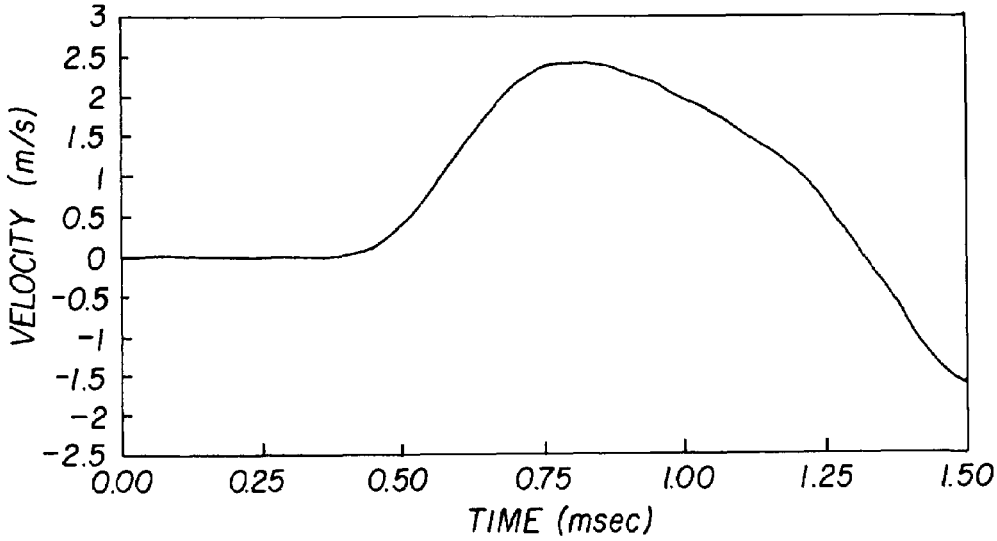
FIG. 13 is a graph illustrating plate velocity vs. time of a pulse generated by the device of FIG. 8.

FIGS. 10 and 11 respectively illustrate voltage and current waveforms for actual tests conducted using the device of FIG. 8. As shown in FIG. 10, a voltage pulse having an amplitude of approximately 3 kV and a duration of 0.5 msec was employed. FIG. 11 illustrates the current waveform related to the voltage pulse illustrated in FIG. 10. The resulting pressure pulse is illustrated in FIG. 12 along with a graph illustrating the plate velocity. In the illustrated example, a peak pressure of close to 400 psi was obtained.

Figure 14:
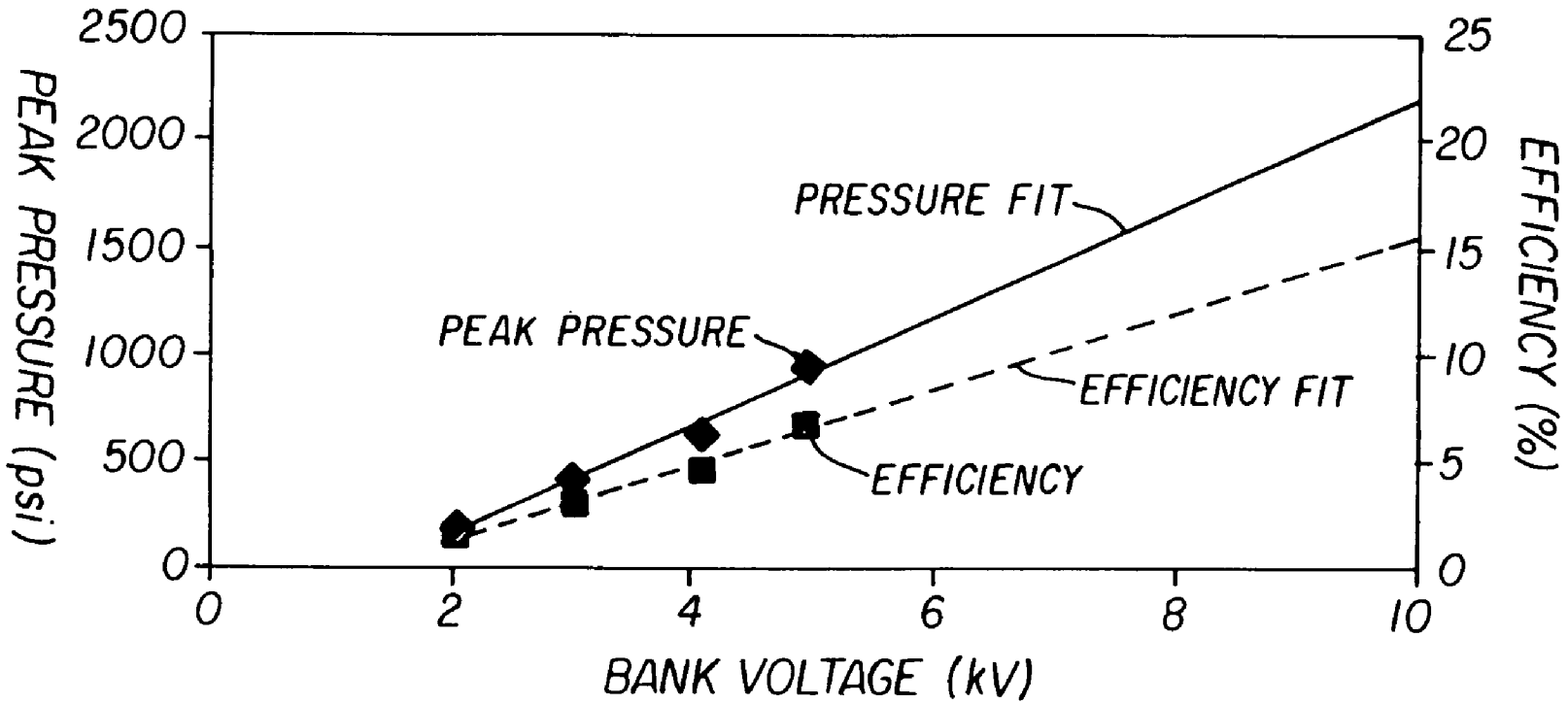
FIG. 14 is a graph illustrating peak pressure and efficiency vs. bank voltage of the device illustrated in FIG. 8.
Figure 15:
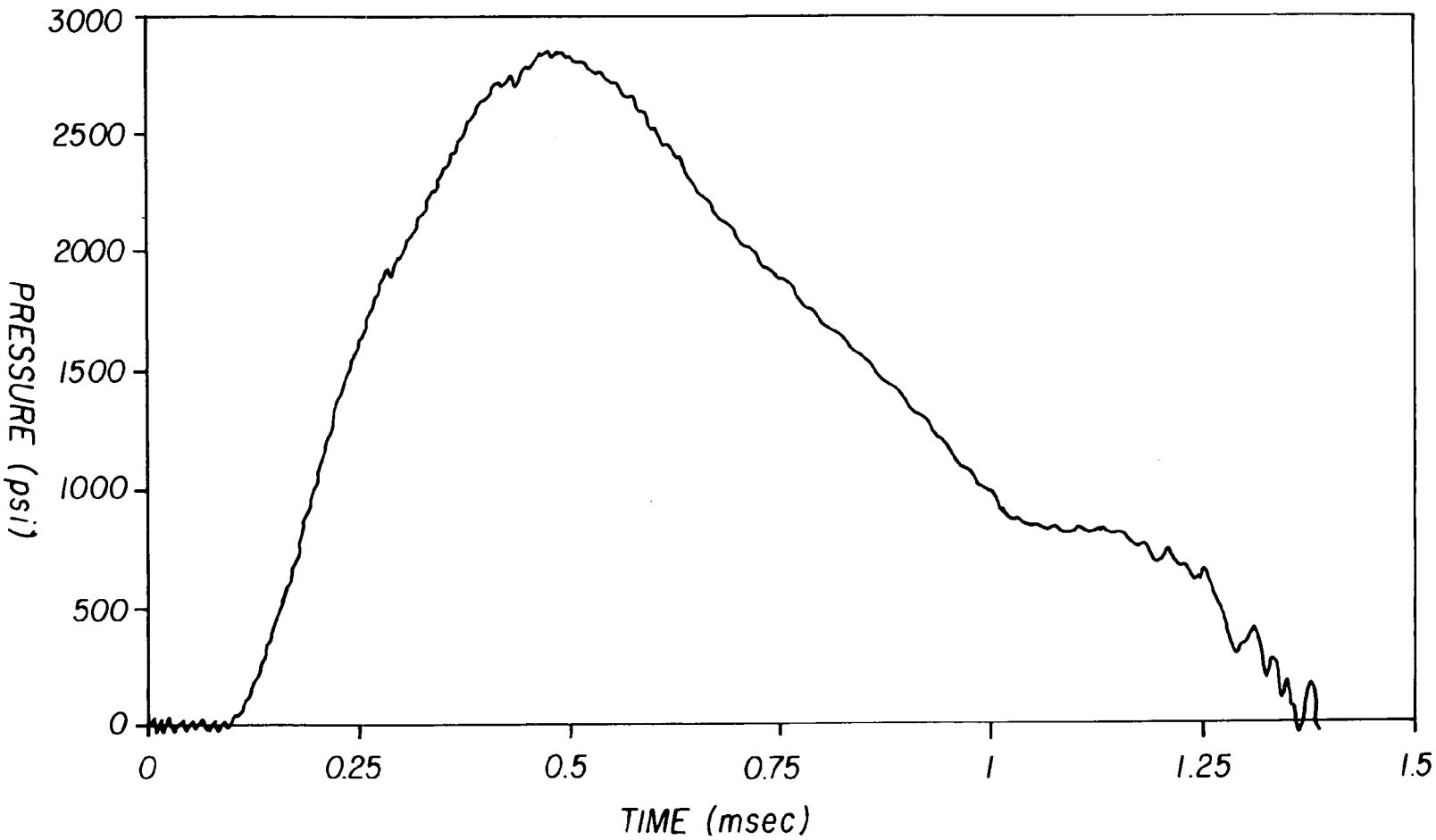
FIG. 15 is a graph illustrating peak pressure vs. time for a pulse generated by the device of FIG. 8 having a voltage of 10 kV.

FIG. 14 illustrates a graph showing how the peak pressure and efficiency will vary with the voltage utilized. As illustrated in FIG. 14, higher voltages can result in peak pressures in the ranges of thousands of psi. FIG. 15 illustrates a test conducted using a voltage of 10 kv which resulted in a peak pressure of nearly 3000 psi within 0.5 msec, sufficient to cause a shock wave on the order of magnitude of an explosive charge.

It should be noted that an array of devices may be employed that function in a coherent manner to operate in a high pressure regime. For example, an array of devices may be controlled such that the individual activation of devices within the array causes a series of pressure pulses to be generated. The series of pulses may be timed and configured to have an accumulative effect upon reaching a certain range and/or location from the array. Accordingly, while each individual pulse may not in itself represent sufficient energy to incapacitate the threat, the accumulation of the energy of multiple pulses from multiple sources at a given point provides a sufficient destructive force. Accordingly, it is possible to focus or steer the location of the accumulated pulse to scan within a region.

As illustrated above, the invention provides an apparatus and method for generating an underwater pressure pulse sufficient to generate a shock wave equivalent to an explosive charge. Accordingly, the apparatus and method can be used to defeat underwater threats by inducing a shock wave capable of setting off underwater mines or incoming torpedoes, as well as disabling hostile demolition personnel. Since the invention does not use conventional explosives, it does not have the drawbacks of conventional anti-marine countermeasure systems. Further, the invention can be employed to protect stationary targets as well as ships in transit. Still further, the shock wave can be "fired" periodically with much less subsidiary damage than the use of conventional explosives. Accordingly, a system can be employed in which the shock wave is periodically generated regardless if a threat is actually detected, thereby providing enhanced security without the requirement for improved detection.

The invention has been described with reference to certain preferred embodiments thereof. It will be understood, however, that modifications and variations are possible within the scope of the appended claims.

What is claimed is:

1. An apparatus for generating an underwater pressure pulse comprising:

a fixed electrically conductive element;

a movable electrically conductive element arranged substantially parallel to the fixed electrically conductive element;

and a pulse generator connected to at least one of the movable electrically conductive element and the fixed electrically conductive element;

wherein the movable electrically conductive element is displaced with respect to the fixed electrically conductive element to produce a shock wave when an electrical pulse is generated by the pulse generator to induce a magnetic repulsion force between the movable electrically conductive element and the fixed electrically conductive element.

2. An apparatus as claimed in claim 1, wherein the pulse generator includes a capacitor bank in series with a switch and arranged in parallel with a diode array.

3. An apparatus as claimed in claim 1, wherein the movable electrically conductive element is returned to an initial position relative to the fixed electrically conductive element after the electrical pulse dissipates.

4. An apparatus as claimed in claim 1, wherein at least one of the fixed electrically conductive element and the movable electrically conductive element comprises a plate.

5. An apparatus as claimed in claim 1 comprising: wherein a plurality of fixed electrically conductive elements are provided and a plurality of corresponding movable electrically conductive elements are provided to form a plurality of electrically conductive plate pairs.

6. An apparatus as claimed in claim 1, wherein the plurality of electrically conductive plate pairs are configured in a solenoid arrangement such that the number of conductive plate pairs corresponds to a number of windings of the solenoid arrangement.

7. An apparatus as claimed in claim 6, wherein the plurality of electrically conductive plate pairs are configured in a solenoid arrangement such that the number of conductive plate pairs corresponds to a number of windings of the solenoid arrangement.

8. An apparatus for generating an underwater pressure pulse as claimed in claim 1, wherein at least one of the fixed electrically conductive element and the movable electrically conductive element comprises a DC wired electrically conductive coil.

9. A method of generating an underwater pressure pulse comprising: submerging at least one pair of electrically conductive elements in a liquid, wherein the pair of electrically conductive elements includes a fixed electrically conductive element and a movable electrically conductive element arranged substantially parallel to the fixed electrically conductive element; and generating an electrical pulse with an electrical a pulse generator connected to at least one of the movable electrically conductive element and the fixed electrically conductive element; and inducing a magnetic repulsion force between the movable electrically conductive element and the fixed electrically conductive element; wherein the movable electrically conductive element is displaced with respect to the fixed electrically conductive element to generate a shock wave within the liquid.

10. A method as claimed in claim 9 further comprising returning the movable electrically conductive element to an initial position relative to the fixed electrically conductive element after the electrical pulse dissipates.

11. A method as claimed in claim 9 further comprising generating a plurality of electrical pulses at periodic time intervals.

12. An apparatus for generating an underwater pressure pulse comprising: shock wave generation means for generating a shock wave in a liquid based on a magnetic repulsion force in response to an electrical signal; signal generation means for generating the electrical signal; and signal transmission means for supplying the electrical signal to the shock wave generation means.

13. An apparatus as claimed in claim 12, wherein the shock wave has a peak pressure on the order of magnitude of an explosive charge.

14. An apparatus as claimed in claim 12, wherein the shock wave has a peak pressure of at least about 3000 psi.

15. An apparatus for generating an underwater pressure pulse comprising:

a fixed electrically conductive element;

a movable electrically conductive element arranged substantially parallel to the fixed electrically conductive element;

and a pulse generator connected to the movable electrically conductive element and the fixed electrically conductive element;

wherein the movable electrically conductive element is displaced with respect to the fixed electrically conductive element when an electrical pulse is generated by the pulse generator to induce a magnetic repulsion force between the movable electrically conductive element and the fixed electrically conductive element.

* * * * *